US008465238B2

(12) United States Patent
Meidl et al.

(10) Patent No.: US 8,465,238 B2
(45) **Date of Patent: *Jun. 18, 2013**

(54) SLIDING ANCHOR

(75) Inventors: Michael Meidl, Seeboden (AT); Francois Charette, North Bay (CA)

(73) Assignee: Atlas Copco Mai GmbH (AT)

( * ) Notice: Subject to any disclaimer, the term of this patent is extended or adjusted under 35 U.S.C. 154(b) by 162 days.

This patent is subject to a terminal disclaimer.

(21) Appl. No.: 12/918,821

(22) PCT Filed: Feb. 29, 2008

(86) PCT No.: PCT/EP2008/001625

§ 371 (c)(1),
(2), (4) Date: Aug. 23, 2010

(87) PCT Pub. No.: WO2009/106099

PCT Pub. Date: Sep. 3, 2009

(65) Prior Publication Data

US 2011/0002745 A1 Jan. 6, 2011

(51) Int. Cl.
*F16B 31/02* (2006.01)

(52) U.S. Cl.
USPC ..... 411/8; 411/5; 405/259.1

(58) Field of Classification Search
USPC ..... 405/259.1, 262
See application file for complete search history.

(56) References Cited

U.S. PATENT DOCUMENTS 2,822,986 A 2/1958 Schreier
2,829,502 A 4/1958 Dempsey
2,870,666 A 1/1959 Dempsey
3,319,209 A 5/1967 Reyenga
3,349,662 A 10/1967 Williams (Continued)

FOREIGN PATENT DOCUMENTS

DE 2629351 9/1977
DE 2751020 5/1978

(Continued)

OTHER PUBLICATIONS

Russian Patent Application No. 2010139319/03(056251) filed Feb. 29, 2008; Decision on Granting a Patent for Invention, dated Nov. 10, 2011. 4 pages.

(Continued)

*Primary Examiner* — Thomas B Will
*Assistant Examiner* — Patrick Lambe
(74) *Attorney, Agent, or Firm* — Schmeiser, Olsen & Watts, LLP

(57) ABSTRACT

The invention relates to a sliding bolt (10) for introducing into a bore, having an anchor rod (12), on which is disposed a sliding control element (14) with a through-opening (18), through which the anchor rod (12) extends, wherein the sliding control element (14) comprises a sliding body cage (16) having at least one recess (20) for receiving a sliding body (22) that is in contact with the lateral surface of the anchor rod (12), and having an anchor plate (24), which is intended to lie against a region surrounding the mouth of the bore once the sliding bolt (10) has been introduced into the bore. In contrast to conventional sliding bolts, the anchor plate (24) is in load-transferring connection with the sliding body cage (16), with the result that it is easily possible to provide a device that indicates a sliding path of the sliding bolt that is still available.

28 Claims, 5 Drawing Sheets

U.S. PATENT DOCUMENTS

| | | | | |
|---|---|---|---|---|
| 3,967,455 | A | 7/1976 | Conway | |
| 4,195,952 | A | 4/1980 | Swanson | |
| 4,339,217 | A | 7/1982 | Lacey | |
| 4,378,180 | A | 3/1983 | Scott | |
| 4,403,894 | A | 9/1983 | Clark | |
| 4,431,348 | A | 2/1984 | Powondra | |
| 4,560,305 | A | 12/1985 | Powondra | |
| 4,630,971 | A | 12/1986 | Herbst et al. | |
| 4,681,495 | A | 7/1987 | Crespin et al. | |
| 4,776,729 | A | 10/1988 | Seegmiller | |
| 4,850,746 | A | 7/1989 | Finsterwalder et al. | |
| 4,932,642 | A | 6/1990 | Salenbien et al. | |
| 4,946,315 | A | 8/1990 | Chugh et al. | |
| 5,009,549 | A | 4/1991 | Stankus | |
| 5,161,916 | A | 11/1992 | White et al. | |
| 5,253,960 | A | 10/1993 | Scott | |
| 5,846,041 | A | 12/1998 | Bevan et al. | |
| 5,882,148 | A | 3/1999 | Mraz | |
| 5,885,031 | A | 3/1999 | White | |
| 6,095,739 | A * | 8/2000 | Albertson et al. | 411/439 |
| 6,474,910 | B2 | 11/2002 | Lay | |
| 6,626,610 | B1 | 9/2003 | Seegmiller | |
| 6,742,966 | B2 | 6/2004 | Cook | |
| 7,037,046 | B2 | 5/2006 | Fergusson | |
| 7,147,404 | B2 | 12/2006 | Spearing et al. | |
| 7,465,128 | B2 | 12/2008 | Bruneau | |
| 7,955,034 | B2 * | 6/2011 | Meidl | 411/8 |
| 2004/0136789 | A1 | 7/2004 | Fergusson | |
| 2004/0161316 | A1 | 8/2004 | Locotos et al. | |
| 2006/0067795 | A1 | 3/2006 | Spearing et al. | |
| 2006/0072972 | A1 | 4/2006 | Spearing et al. | |
| 2007/0031196 | A1 | 2/2007 | Bruneau | |
| 2009/0269159 | A1 | 10/2009 | Meidl | |

FOREIGN PATENT DOCUMENTS

| | | | |
|---|---|---|---|
| DE | 3342746 | A1 | 6/1984 |
| DE | 3311145 | | 9/1984 |
| DE | 3344511 | | 6/1985 |
| DE | 10354729 | | 6/2005 |
| EP | 1533471 | | 5/2005 |
| GB | 651556 | | 4/1951 |
| JP | 02210199 | | 8/1990 |
| SU | 381785 | | 5/1973 |
| SU | 883481 | | 11/1981 |
| SU | 926318 | | 5/1982 |
| SU | 941607 | | 7/1982 |
| WO | 9613651 | | 5/1996 |
| WO | 0008304 | | 2/2000 |

OTHER PUBLICATIONS

U.S. Appl. No. 12/438,562, filed Feb. 24, 2009.

* cited by examiner

SLIDING ANCHOR

FIELD OF THE TECHNOLOGY

The invention relates to a sliding bolt for introducing into a bore, wherein the sliding bolt comprises an anchor rod, on which is disposed a sliding control element with a through-opening, through which the anchor rod extends, as well as an anchor plate, which is intended to lie against the region surrounding the mouth of the bore after the sliding bolt has been introduced into the bore, and wherein the sliding control element comprises a sliding body cage having at least one recess for receiving a sliding body that is in contact with the lateral surface of the anchor rod. Such a sliding bolt is known from WO 2006/034208 A1.

BACKGROUND

Sliding bolts belong to the group of so-called rock bolts. Rock bolts are used in mining, tunnel construction and special civil engineering to stabilize the wall of a gallery, tunnel or embankment. For this purpose, a bore that is conventionally between two and twelve meters long is driven from the gallery or tunnel into the rock. Into this bore a rock bolt of corresponding length is then introduced, the end portion of which is permanently fixed in the bore by means of mortar, special synthetic resin adhesives or mechanical bracing. An anchor plate is usually mounted onto the end of the bolt projecting from the bore and is clamped by means of a nut against the wall of the gallery or tunnel. In this way, loads that are effective in the region of the gallery-or tunnel wall are introduced into deeper layers of rock. In other words, with the aid of such rock bolts rock layers that are more remote from the wall are used to transfer loads in order to minimize the risk of a collapse of the gallery or tunnel.

Conventional rock bolts are capable of transferring a maximum load corresponding to their mechanical design and break if this load (so-called load at break) is exceeded. In order as far as possible to prevent such a total failure of a fitted rock bolt that is triggered for example by rock shifts, so-called sliding bolts have been developed, which, if a predetermined load is exceeded, yield to a defined extent, i.e. may increase their length within specific limits, in order to reduce a stress acting in the rock to a level that may still be transferred by the bolt. Such sliding bolts are designed with a preset sliding path that may be travelled if the predetermined load is exceeded, i.e. as a result of the defined yielding under increased load the total length of the sliding bolt may be lengthened by at most this sliding path. It is desirable if by visually inspecting the sliding bolt it is possible to establish rapidly and unambiguously whether a specific sliding bolt has already yielded to the defined extent, i.e. whether its sliding path has been already partially or completely used up, for this information makes it possible firstly to draw conclusions about the occurrence of rock movements and secondly to be better able to plan the time when a fitted sliding bolt possibly has to be exchanged or supplemented by further rock bolts. If namely the sliding path of the sliding bolt has been completely used up and further rock movements occur, the sliding bolt may fail after its load at break is exceeded.

SUMMARY

The invention aims at the provision of a sliding bolt that offers improved design conditions for the installation of a device that indicates in a rapidly and reliably detectable manner a sliding path that is still available.

Proceeding from the initially described known sliding bolt, this advantage is achieved in that the anchor plate is in load-transferring connection with the sliding body cage of the sliding control element. In other words, for the transfer of in particular tensile and compressive forces the anchor plate is interlocked with the sliding control element so that, if the predetermined load of the sliding bolt is exceeded, the sliding control element slips over the anchor rod, whereas in the known form of construction, if the predetermined load was exceeded, the sliding control element remained stationary and the anchor rod slipped through the sliding control element. In the case of the conventional known sliding bolt the anchor plate, which is supported from outside against the rock wall to be stabilized, is connected in a fixed manner to the anchor rod. If rock movements lead to a pressure upon the anchor plate that exceeds the predetermined load of the sliding bolt, the anchor rod connected to the anchor plate slips outwards through the sliding control element in order by means of the lengthening of the sliding bolt thereby achieved to yield in a defined manner to the load. However, such a lengthening of the sliding bolt, i.e. the gradual using-up of the available sliding path in dependence upon the rock movements, is not readily detectable from the outside. It is only if a wire for example was installed at the time of fitting the sliding bolt that it is possible to obtain information about whether rock movements have occurred and which portion of the sliding path has consequently already been used up.

In the case of the sliding bolt, on the other hand, the anchor plate is in load-transferring connection with the sliding body cage so that, in the event of rock movements occurring and resulting in pressure upon the anchor plate, the sliding control element slips over the anchor rod if the predetermined load of the sliding bolt is exceeded. The anchor rod, on the other hand, remains stationary and its free end situated in the region of the bore mouth slips during the sliding operation into the sliding bolt. Thus, it is easily possible to establish whether a specific sliding bolt has already passed through sliding states and to what extent its sliding path has already been used up.

According to one form of construction of the sliding bolt, the sliding body cage is a component part of an assembly adapter that is used to fix the anchor plate against the region of the rock wall that surrounds the bore mouth. Given this form of construction, the sliding body cage and hence the entire sliding control element is situated relatively close to, or even in, the bore mouth. Preferably, in such a form of construction a protective tube concentrically surrounding the anchor rod extends from the anchor plate into the bore in order to protect the anchor rod, in particular from being crushed by shifting rock plates. The protective tube may extend as far as into the region of the bore-side end of the sliding bolt and is made preferably of metal, in particular steel, or of plastics material.

In this case, the anchor rod preferably projects through the anchor plate and the assembly adapter out of the bore. If the length of the portion of the anchor rod that projects from the bore is known, subsequent variations that arise as a result of rock movements may easily be verified on the basis of the shortening of the portion that then occurs. To simplify the detection of such variations, the portion of the anchor rod projecting from the bore is preferably provided with one or more markings, by means of which a sliding path that is still available may be visually detected. For example, the portion of the anchor rod projecting from the bore may be provided with a uniform scale division in the manner of a measuring rod, so that it is immediately possible to read off the sliding path already used up in the course of rock movements. In a modified form of construction, the markings are coloured markings, wherein preferably a region of the anchor rod next to the anchor plate is coloured green, a region axially adjacent thereto is coloured yellow, and a succeeding region comprising the free end of the anchor rod is coloured red. When the sliding bolt is fitted, it is adjusted in such a way all three colour-marked regions of the anchor rod are visible from outside. Then, during operation, as a result of rock movements first the green region may "disappear", i.e. move into the sliding bolt, then the yellow region and finally the red region. So long as the green region or a portion thereof is still visible from outside, this indicates that everything is in order. If only the yellow region (or a portion thereof) and the red region project from the sliding bolt, this indicates that this sliding bolt should be monitored more closely as it is quite obvious that there is an increasing occurrence of rock movements. Finally, if only the red region projects from the sliding bolt, this indicates that the situation is starting to become critical and it is necessary to consider replacing the sliding bolt soon or fitting additional sliding bolts.

In another form of construction of the sliding bolt, a protective tube concentrically surrounding the anchor rod extends from the anchor plate in the direction of the bore-side end of the anchor rod (i.e. inwards into the bore) and is fastened by its one end to the sliding body cage and by its other end to the anchor plate. The protective tube is therefore used here to transfer loads between the anchor plate and the sliding body cage. In principle any type of connection that ensures the transfer of load between the interconnected parts is suitable for fastening the protective tube to the sliding body cage and/or to the anchor plate. For example, the one end of the protective tube may be welded to the sliding body cage. It may however alternatively be connected by screwing or clamping to the sliding body cage. A form of construction, in which the protective tube is integrally connected to the sliding body cage, is equally possible. For fastening the protective tube to the anchor plate, an assembly adapter that is screwed onto the free end of the protective tube may be used. Other types of connection that are familiar to a person skilled in the art are equally possible.

If an assembly adapter is used to fasten the free end of the protective tube to the anchor plate, then this assembly adapter preferably has a through-recess, which is disposed coaxially with the anchor rod and through which the anchor rod may extend. Preferably, there is then fastened on the free end of the anchor rod or in the region thereof a stop element, the diameter of which is larger than the diameter of the through-opening. In this way the sliding control element may be prevented from slipping down off the anchor rod. For example, the stop element is a nut that is screwed or fastened in some other way onto the end portion of the anchor rod. If the stop element strikes against the sliding control element, a further defined yielding of the sliding bolt is no longer possible. The sliding bolt may then be loaded up to its load at break resulting from the mechanical design and, after this load at break is exceeded, will fail, for example the anchor rod will then break.

In an initial state of the sliding bolt the stop element is situated preferably in the through-recess of the assembly adapter. In an advantageous form of construction, in the initial state of the sliding bolt the outside end face of the stop element terminates flush with an outer edge of the assembly adapter that surrounds the end face. In the event of rock movements occurring and leading to a lengthening of the sliding bolt, the stop element moves into the sliding bolt, more precisely into the through-recess, this being clearly detectable from outside.

According to a development of the previously discussed form of construction, the anchor rod or an extension thereof projects out of the assembly adapter and is preferably provided with one or more markings that indicate a sliding path that is still available. These markings may be designed in the manner indicated above in connection with the first form of construction. Alternatively, a sliding-path detection element, in particular a band, wire, thread or the like may be fastened in the region of the free end of the anchor rod. Upon a change of length of the sliding bolt as a result of sliding of the sliding control element, the sliding-path detection element is then drawn in a corresponding manner into the sliding bolt, so that by means of a comparison with the originally projecting length of the sliding-path detection element the sliding path that has already been used up may easily be determined.

In the previously described forms of construction, in which a load-transferring protective tube extends between the anchor plate and the sliding body cage, a further protective tube may be provided, which extends from the sliding control element as far as into the region of the bore-side end of the anchor rod and concentrically surrounds the anchor rod. As in the form of construction first described, this protective tube is used to protect the anchor rod, in particular from being crushed by the shifting rock plates, and is made preferably of metal, in particular steel, or of plastics material.

In sliding bolts of the described type it is moreover desirable that the load, at which the sliding bolt yields to a defined extent, may be adjusted as precisely as possible and also varies as little as possible during yielding in order, on the one hand, to enable an exact mechanical design of the rock bolt and, on the other hand, to be able to realize during operation a behaviour that is as highly predictable as possible. Furthermore, the so-called breakaway load, i.e. the load, after the exceeding of which the sliding bolt yields to a defined extent, is to be repeat-accurate in order to prevent an uncontrolled change of the load of the sliding bolt during different, chronologically discrete phases of such a defined yielding.

In order to achieve this, in all of the previously described forms of construction preferably each recess for receiving a sliding body in the sliding body cage is disposed tangentially to the lateral surface of the anchor rod, and moreover the lateral enveloping surface of each recess projects by a predefined dimension into the clear cross section of the through-opening, and finally each sliding body fills the cross section of the recess associated with it. By the expression "tangentially to the lateral surface of the anchor rod" is meant in the present case not an exact tangentiality in the mathematical sense, in which case the lateral enveloping surface of the recess would be tangent merely to the lateral surface of the anchor rod, but a substantially tangential arrangement of the recesses for receiving sliding bodies in relation to the lateral surface of the anchor rod, in which case the central longitudinal axis of each recess is arranged skew relative to the central longitudinal axis of the anchor rod, wherein in a projection of the central longitudinal axis of the anchor rod and the central longitudinal axis of any one recess for receiving a sliding body these two axes may be, but need not be, orthogonal to one another. The central longitudinal axis of a recess for receiving a sliding body may accordingly lie in a plane that cuts the central longitudinal axis of the anchor rod at a right angle (the axes in question in the described projection are then orthogonal to one another) but it may also lie in a plane that is oblique relative to the central longitudinal axis of the anchor rod.

Such an embodiment of a sliding bolt has a number of advantages. By virtue of the fact that the lateral enveloping surface of each recess provided in the sliding body cage for receiving a sliding body projects by a predefined amount into the clear cross section of the through-opening of the sliding control element, it is possible with the aid of this amount to preset very precisely the clamping force, with which the sliding body or bodies secure the anchor rod extending through the through-opening. Furthermore, this clamping force, once set, after a single start-up operation is also achievable with repeat accuracy because each sliding body apart from conventional tolerances fills the cross section of the recess associated with it, so that the predefined amount, by which each sliding body projects into the clear cross section of the through-opening, does not alter during operation of the sliding bolt, and in particular does not alter even if during operation a plurality of chronologically discrete sliding phases of the sliding control element occurs. Finally, the load transfer between the, optionally sliding, sliding control element and the anchor rod is advantageously cancelled since, because the sliding bodies fill the cross section of the recesses, material deformation occurs not at the sliding bodies nor at the sliding body cage but only at the anchor rod. A precondition of this is of course that—as is already the case in the cited background art—the material hardness of the sliding bodies is greater than that of the anchor rod.

Further influencing variables that may influence the clamping- and/or breakaway force are the shape of the sliding body or bodies and of the sliding body cage, the number of sliding bodies, the nature of their surface in contact with the anchor rod, the material pairing between sliding body and anchor rod as well as between sliding body and sliding body cage, and the shape and nature of the surface of the anchor rod.

In principle, the sliding bolt already functions with one recess and one sliding body disposed therein. Preferably, however, a plurality of recesses are disposed in the sliding body cage and are arranged advantageously distributed around the circumference of the anchor rod, in particular uniformly distributed around the circumference. By means of a plurality of recesses and a corresponding number of sliding bodies the desired breakaway force may be set even more precisely, furthermore with a plurality of recesses and sliding bodies disposed therein it is easily possible to realize higher clamping- and/or breakaway forces. A uniform distribution of the recesses and sliding bodies around the circumference of the anchor rod spreads the loads acting upon the anchor rod more evenly.

Each of the plurality of recesses may be disposed on a different level in the sliding body cage, i.e. each in its own cross-sectional plane of the sliding body cage. However, to achieve a more compact style of construction of the sliding control element preferably a plurality of recesses are disposed in one cross-sectional plane of the sliding body cage. The number of recesses possible in one cross-sectional plane depends upon the dimension of the recesses and the dimension of the sliding body cage. In one embodiment of a sliding bolt, three recesses are disposed in a cross-sectional plane but, given a sliding bolt of larger dimensions and a correspondingly larger sliding control element, more than three of such recesses is also possible. Furthermore, likewise with a view to achieving a compact style of construction and uniform load distribution, preferably a plurality of recesses are disposed in groups in different cross-sectional planes of the sliding body cage. Such an embodiment is preferably selected if the spatial conditions do not permit an arrangement of the desired number of recesses in one cross-sectional plane. For example, in another form of construction of the sliding bolt, in each case three recesses are disposed in two different cross-sectional planes of the sliding body cage. The recesses of the different cross-sectional planes are in this case advantageously offset at an angle to one another in such a way that the sliding bodies disposed in the recesses of the one cross-sectional plane contact other regions of the lateral surface of the anchor rod than the sliding bodies disposed in the other cross-sectional plane or planes.

Within the scope of the present invention the shape of the employed sliding bodies may be selected in almost any desired manner. For example, the sliding bodies may be spherical or have a conically tapering external shape, for example a tapered roller shape. According to a preferred form of construction the sliding bodies have a circular-cylindrical shape, are therefore roller-shaped. Furthermore, the lateral surface of each sliding body may be crowned, i.e. bulge outwards, for example in the manner of a wine barrel. Prismatic sliding bodies are also possible. It is self-evident that the shape of the recesses has to be adapted to the employed sliding bodies at least to the extent that each sliding body is accommodated in its recess substantially free of play. As a rule, the shape of the recess will correspond to the shape of the employed sliding body, i.e. a circular-cylindrical sliding body will be disposed in a circular-cylindrical recess, a conical sliding body in a conical recess etc., this correspondence however not being obligatory.

In preferred embodiments of sliding bolts a mixing- and anchoring element is fastened to the bore-side end of the anchor rod. If two-component adhesive resins are used to fasten the bolt in the bore, the two components are introduced into the bore conventionally in the form of adhesive cartridges, in which the two components are accommodated separately from one another for example in two chambers that are concentric with one another. Then, during fitting of the bolt the mixing- and anchoring element first destroys the chambers formed for example from a plastic film and a simultaneous or subsequent rotation of the anchor rod then leads to the intimate mixing of the two components, which then cure rapidly into the finished adhesive resin.

In preferred forms of construction of the sliding bolt the assembly adapter at its free end is designed to couple with an assembly device, which rotates the assembly adapter and hence the sliding body cage, the anchor rod and the mixing- and anchoring element during introduction of the sliding bolt into the bore. Given such forms of construction, the fastening of the assembly adapter to the sliding body cage and to the anchor plate therefore has to be designed in a way that allows the transmission of rotational forces.

BRIEF DESCRIPTION OF THE DRAWINGS

There now follows a detailed description of a preferred embodiment of a sliding bolt with reference to the accompanying diagrammatic figures. These show.

DETAILED DESCRIPTION

Figure 1:
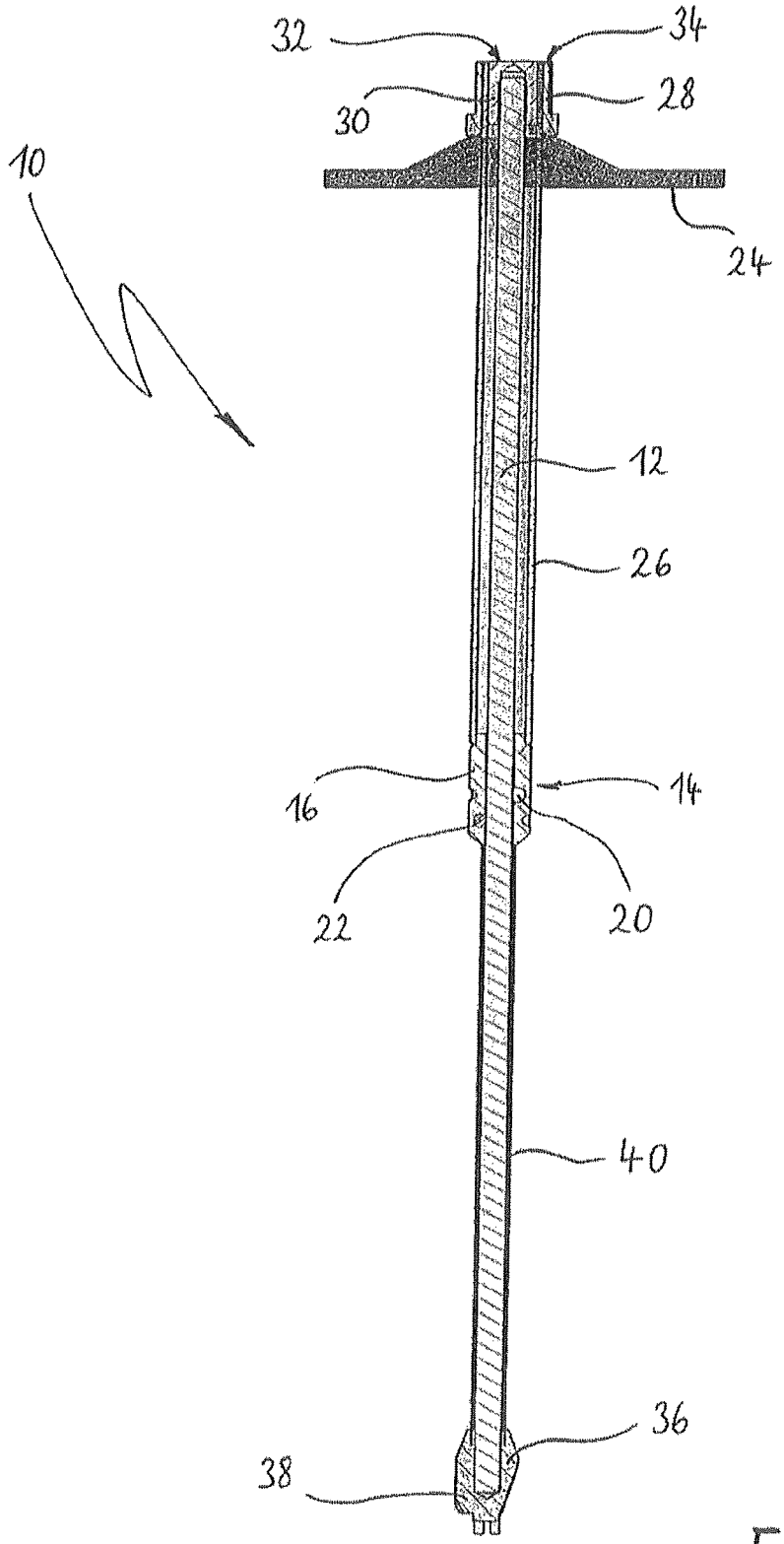
FIG. 1 a longitudinal section through a preferred embodiment of a sliding bolt in accordance with a first form of construction, FIG. 2 a first form of construction of a sliding body cage of the type used in a sliding control element of a sliding bolt, FIG. 3 the section III-III of FIG. 2, FIG. 4 a second embodiment of a sliding body cage of the type used in the sliding control element of the sliding bolt shown in FIG. 1, FIG. 5 the section V-V of FIG. 4, FIG. 6 the section VI-VI of FIG. 4, FIG. 7 a view corresponding to FIG. 5, but with sliding bodies inserted in the sliding body cage, FIG. 8 a view corresponding to FIG. 6, likewise with sliding bodies inserted in the sliding body cage, and FIG. 9 a plan view of a preferred embodiment of a sliding bolt in accordance with a second form of construction.

FIG. 1 shows a sliding bolt that is generally denoted by 10 and is intended to be introduced into a rock bore (not illustrated) in order for example to stabilize the wall of a gallery or tunnel. The central element of this sliding bolt 10 is an anchor rod 12, which represents the load-bearing component of the sliding bolt 10 and the length of which determines the length of the sliding bolt 10. In the illustrated embodiment the anchor rod 12 is a solid, continuous steel rod having a circular cross section and a diameter of 12 mm as well as a smooth lateral surface, the length of which here is two meters. Depending on the desired load transfer capacity the diameter of the anchor rod 12 may however be smaller or greater than 12 mm and depending on the installation conditions its length may also be shorter or longer than previously indicated. The lateral surface of the anchor rod 12 also need not be smooth but may be for example roughened, grooved etc. Although anchor rods having a circular cross section are preferred, the invention is not limited thereto and the cross section of the anchor rod may for example also be square, polygonal etc.

Figure 2:
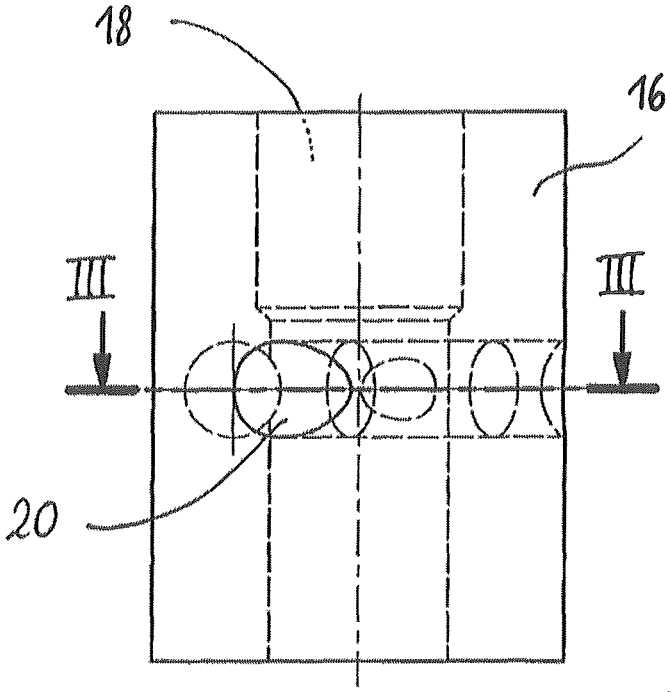
Figure 3:
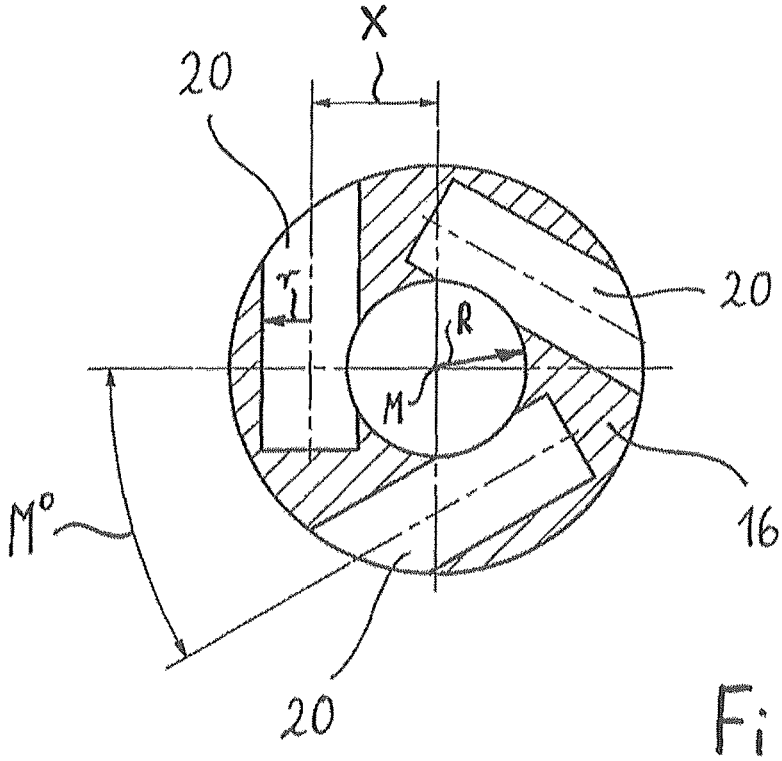

Disposed on a portion of the anchor rod 12 that is intended to be introduced into the non-illustrated rock bore is a sliding control element 14, the basic construction of which is better revealed in FIGS. 2 and 3. The sliding control element 14 is used to allow a limited relative displacement between the anchor rod 12 and the sliding control element 14 so that the sliding bolt 10 is able to cope better with rock shifts that occur after it has been fitted and does not fail prematurely.

The sliding control element 14 comprises a hollow-cylindrical sliding body cage 16 with a central, axially extending through-opening 18 (see FIG. 2), which in the illustrated example is of a slightly stepped design and through which in the assembled state of the sliding bolt 10 the anchor rod 12 extends.

As is evident from the section shown in FIG. 3, three recesses 20 in the form of circular-cylindrical bores are formed uniformly distributed around the circumference of the sliding body cage 16 and are arranged in such a way that their lateral enveloping surface projects slightly into the clear cross section of the through-opening 18. In other words, a dimension X that defines the distance between the centre M of the through-opening 18 and the central longitudinal axis of each recess 20 is slightly smaller than the sum of the radius R of the through-opening 18 and the radius r of the recess 20.

The recesses 20 are disposed substantially tangentially relative to the lateral surface of the anchor rod 12, i.e. their central longitudinal axes are skew relative to the central longitudinal axis of the through-opening 18 and, in relation to a projection that contains the central longitudinal axis of the through-opening 18 and the central longitudinal axis of in each case one recess 20, are orthogonal to the central longitudinal axis of the through-opening 18. The three recesses 20 are therefore disposed in one and the same cross-sectional plane of the sliding body cage 16. An angle $M^{o}$ in the illustrated embodiment is 30°.

Figure 4:
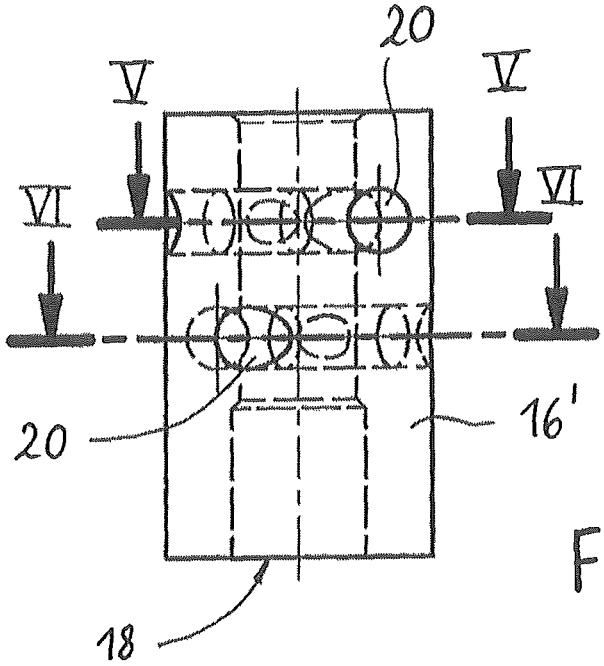
Figure 5:
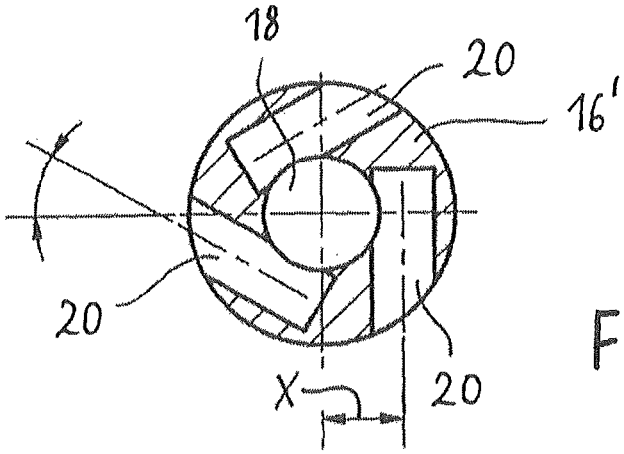
Figure 6:
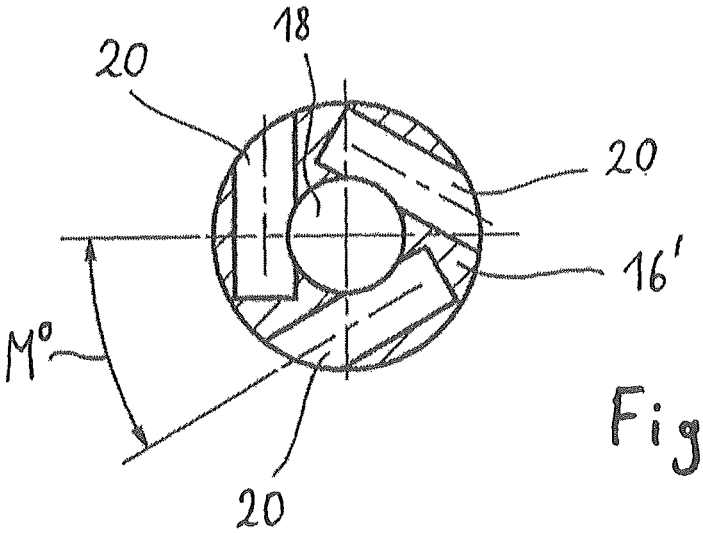

FIGS. 4 to 6 show a second embodiment of a sliding body cage 16', the basic construction of which corresponds to the sliding body cage 16. Unlike the sliding body cage 16, however, the sliding body cage 16' has two planes disposed one above the other and having three recesses 20 each, wherein the recesses 20 of the one cross-sectional plane are offset in circumferential direction relative to the recesses 20 of the other cross-sectional plane such that all six recesses 20 together are distributed uniformly around the circumference of the sliding body cage 16'.

Figure 7:
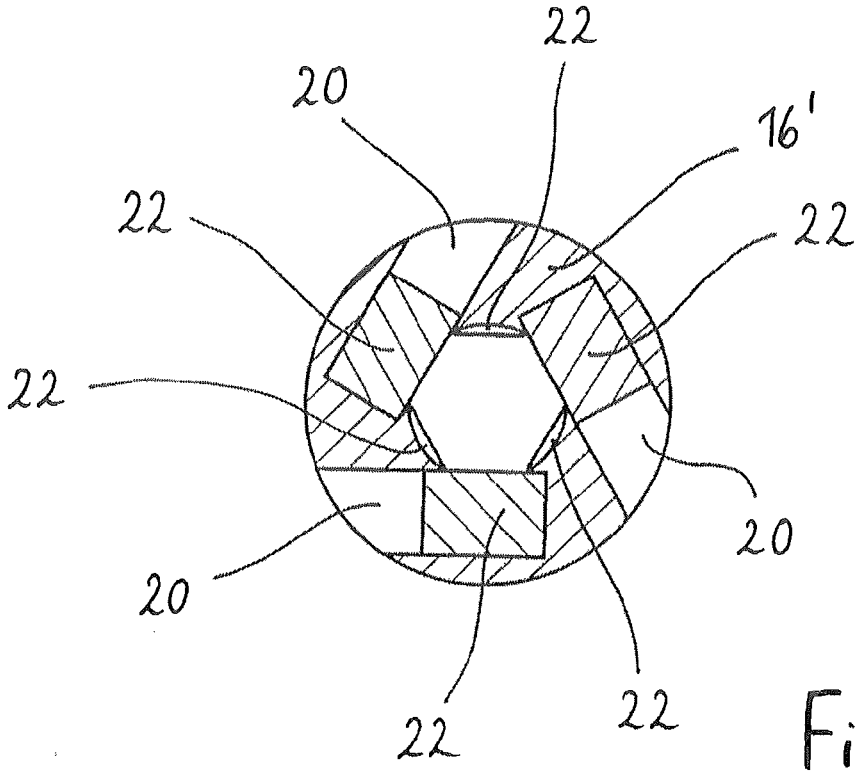
Figure 8:
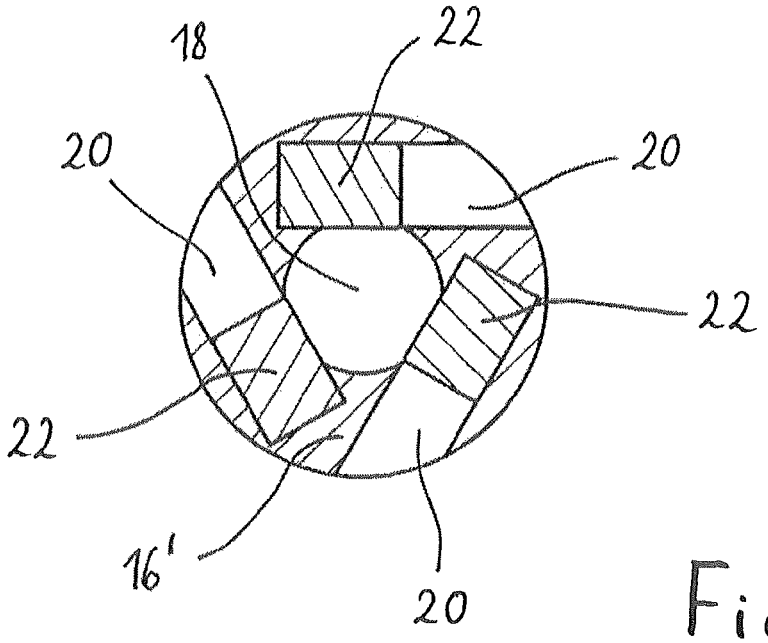

Each recess 20 is provided for receiving an, in the present case circular-cylindrical, sliding body 22, the outside diameter of which apart from conventional tolerances corresponds to the diameter of the recess 20, i.e. which completely fills the cross section of the recess 20. FIGS. 7 and 8 show the views, which correspond to FIGS. 5 and 6 and in which a sliding body 22 designed in the manner described above is disposed in each recess 20. As is clearly evident in particular from FIG. 7, because of the described arrangement of the recesses 20 each sliding body 22 projects with its lateral surface slightly into the cross section of the through-opening 18. Thus, the anchor rod 12, the outside diameter of which almost corresponds to the diameter of the through-opening 18, is held clamped by the sliding bodies 22.

Returning to FIG. 1, the further construction of the sliding bolt 10 is now described.

In order to enable the sliding bolt 10 to exert a stabilizing action on a gallery- or tunnel wall a load-transferring anchor plate 24 is provided, which is mounted onto the bore-mouth end of the anchor rod 12. The anchor plate 24, which is conventionally likewise made of steel and as a rule is square but may alternatively be of some other shape, has in its centre a through-hole, through which a first protective tube 26 extends. The inside diameter of the protective tube 26 is larger than the outside diameter of the anchor rod 12 so that the protective tube 26 may concentrically surround the anchor rod 12. In the illustrated embodiment the protective tube 26 has substantially the same outside diameter as the sliding body cage 16, thereby resulting in a uniform surface that facilitates introduction into the bore, but the outside diameter of the protective tube 26 may alternatively be larger or smaller than the outside diameter of the sliding body cage 16.

At its free end projecting from the anchor plate 24 the protective tube 26 is provided with an external thread, onto which is screwed an assembly adapter 28, which fastens the protective tube 26 to the anchor plate 24. The assembly adapter 28 in the present case takes the form of a hexagonal threaded nut but may alternatively be of some other design.

The first protective tube 26, which is fastened to the anchor plate 24 by means of the assembly adapter 28 in the form of a hexagonal threaded nut, extends from the anchor plate 24 to the sliding body cage 16 (or 16'), to which it is fastened in a load-transferring manner. Such a load-transferring fastening may be effected for example by a welded connection to the sliding body cage 16, but an equally good alternative is for the inner end of the protective tube 26 to have an internal thread, which is screwed onto a matching external thread provided on the sliding body cage 16. According to a non-illustrated variant, the sliding body cage 16 and the first protective tube 26 may also be of an integral construction. The first protective tube 26, which is preferably made of steel or plastics material, therefore establishes a load-transferring connection between the sliding body cage 16 (or 16') and the anchor plate 24.

Fastened to the free end of the anchor rod 12 that projects from the anchor plate 24 is a cylindrical stop element 30, the outside diameter of which is selected so as to be on the one hand smaller than the inside diameter of the first protective tube 26, so that the stop element 30 fits into the protective tube 26, and on the other hand larger than the diameter of the through-opening 18 in the sliding body cage 16 and/or 16'. In the embodiment illustrated in FIG. 1, the free end of the anchor rod 12 has an external thread, onto which the stop element 30 is screwed by means of a matching internal thread formed therein. In the illustrated embodiment, moreover, when the sliding bolt 10 is fitted (i.e. in an initial state of the sliding bolt), an outer end face 32 of the stop element 30 is disposed flush with an outer edge 34 of the assembly adapter 28 that surrounds this end face.

The tip of the sliding bolt 10 is formed by a mixing- and anchoring element 36, which is fastened to the bore-side end of the anchor rod 12 and comprises a plurality of mixing blades 38, which on the one hand are used to mix conventional two-component adhesives, which are used to fasten rock bolts and are introduced into the bore prior to fitting of a bolt, intimately with one another. For this purpose, the anchor rod 12 after being inserted into the bore is rotated, with the result that the mixing element 36 is also set in rotation. On the other hand, the mixing- and anchoring element 36 after curing of the adhesive or mortar is supported against the adhesive or mortar in order in this way to prevent the bolt 10 from being pulled out of the bore.

In the illustrated embodiment a second protective tube 40, which may be made of metal or plastics material, extends from the sliding control element 14 to the mixing element 36. This second protective tube 40 on the one hand keeps the compound (mortar, adhesive), which is used to anchor the sliding bolt 10 permanently in the non-illustrated bore, away from the surface of the anchor rod 12 and on the other hand protects the anchor rod 12 from unwanted clamping- or crushing loads that arise for example as a result of shifting rock plates and may lead to localized overloading of the anchor rod 12. Here, the outside diameter of the second protective tube 40 concentrically surrounding the anchor rod 12 is selected smaller than the outside diameter of the first protective tube 26 so that a substantially hollow-cylindrical adhesive- or mortar plug may be formed from the adhesive or mortar, which is introduced into the bore and during introduction of the bolt 10 into the bore is displaced by the mixing- and anchoring element 36 in an intentional manner at least partially into a region behind the element 36, and have an end face facing the element 36 that is as large as possible in order to offer good, load-bearing support for the element 36. Depending on the intended application of the sliding bolt 10, however, the outside diameter of the second protective tube 40 may alternatively be selected larger than is represented.

Figure 9:
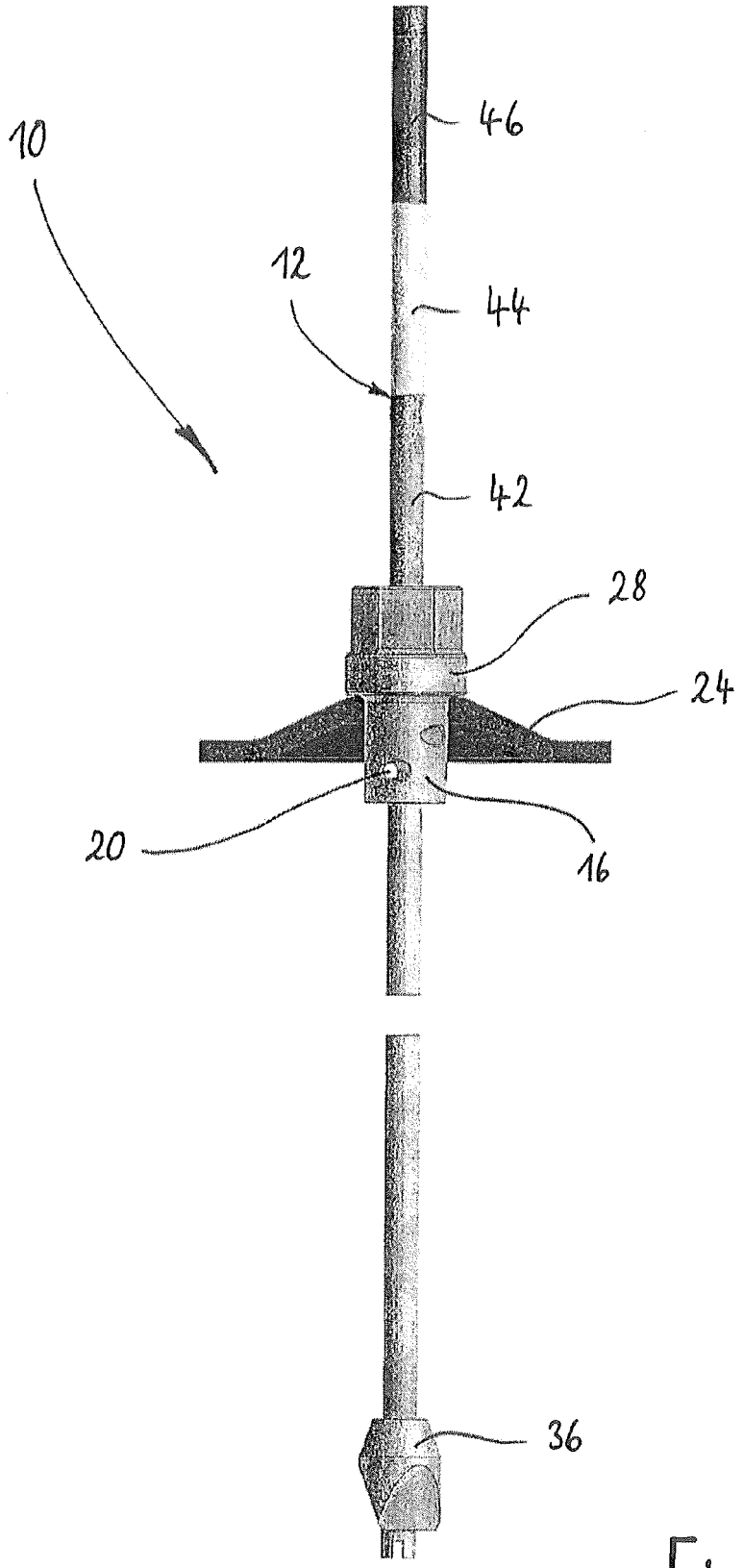

FIG. 9 shows a second embodiment of a sliding bolt 10, in which the sliding control element 14, more precisely its sliding body cage 16 (or 16') is connected directly to the assembly adapter 28. In this embodiment the sliding control element 14 is therefore seated not relatively deep in the bore, into which the sliding bolt 10 is introduced, but in the region of the bore mouth. The through-recess in the anchor plate 24 accordingly has a diameter that apart from conventional tolerances corresponds to the outside diameter of the sliding body cage 16 or 16'. In this embodiment the first protective tube 26 no longer applies or is provided, if need be, in a considerably shortened form. Instead of a short first protective tube 26, the assembly adapter 28 may alternatively have a short neck, which establishes the connection to the sliding body cage 16 or 16', or may be formed integrally with the sliding body cage.

In the second embodiment, an end portion of the anchor rod 12 projects out through the assembly adapter 28 and is provided with coloured markings, the function of which will be described in more detail later. Here, a first region 42 of the projecting end portion that lies adjacent to the assembly adapter 28 is coloured green, a second region 44 adjoining the first is coloured yellow, and a third region 46 comprising the free end of the anchor rod 12 is coloured red. Instead of the coloured markings other markings may be provided, for example uniform scale division lines in the manner of a measuring rod or the like. Otherwise, the construction of the sliding bolt 10 according to the second embodiment corresponds substantially to that of the first embodiment, the stop element 30 however being absent. Such a stop element may however be mounted on the free end of the projecting end portion of the anchor rod 12.

There now follows a detailed description of the function of the sliding bolt 10. After forming a matching bore, the sliding bolt 10 is introduced into the bore and anchored there by means of mortar or adhesives that are known to experts in this field. Alternatively the use of expandable elements, for example expansion sleeves, for anchoring purposes is possible and known. The illustrated sliding bolt 10 is held fast in the bore in particular by means of a plug that is formed by a material displacement of the employed mortar or adhesive behind the mixing- and anchoring element 36, i.e. at the bore mouth side, and after curing of the material prevents the bolt 10 from being pulled out of the bore. After the anchor plate 24 has been mounted and tightened by means of the assembly adapter 28, the sliding bolt 10 may then fulfill its load-bearing, stabilizing function.

Via the sliding bodies 22 a clamping action is exerted on the anchor rod 12, thereby defining a so-called breakaway load that the sliding bolt 10 is able to transfer in axial direction without leading to a relative movement between the anchor rod 12 and the sliding control element 14. However, if this breakaway load is exceeded, for example because rock movements and/or rock shifts lead to a progressive increase of the pressure acting upon the anchor plate 24, the sliding control element 14 may move slidingly over the anchor rod 12 and hence by virtue of an increase of the effective length of the slide bolt 10 yield to the compressive loads until they are once more below the design breakaway load. Such a displacement may of course occur in a plurality of portions and will always occur only until the axial load acting upon the sliding bolt 10 has dropped once more below the breakaway load.

In the first embodiment of the sliding bolt 10 illustrated in FIG. 1, the maximum length by which the sliding bolt 10 may yield, referred to as the sliding path, is defined by the axial distance between the stop element 30 and the sliding body cage 16 or 16'. If the sliding bolt of FIG. 1 yields because of increased load, then the sliding body cage 16 or 16' slips in the direction of the stop element 30. When the sliding body cage 16 or 16' strikes the stop element 30, a further lengthening of the sliding bolt 10 is no longer possible. During the sliding operation the stop element 30 moves from its initial position flush with the assembly adapter 28 further and further into the first protective tube 26, this making it possible to tell at a glance how far the sliding bolt has already yielded.

In the second embodiment of the sliding bolt 10 represented in FIG. 9 it is even easier to "read" the sliding path that is already used up because, as the bolt 10 slides, the colour-marked regions 42, 44 and 46 disappear successively into the bore and only the part of the end portion still projecting from the assembly adapter 28 is visible. If for example the green region 42 has already completely disappeared, from the fact that the yellow region 44 is still projecting it is possible to identify immediately that a not inconsiderable rock movement must have already occurred. The same applies if it is possible to see only the red region 46, this indicating that the sliding bolt 10 will soon have reached the limits of its sliding capacity.

It is naturally also possible to modify the first embodiment according to FIG. 1 in such a way that an end portion of the anchor rod 12 projects from the bore.

The invention claimed is:

1. Sliding bolt for introducing into a bore, having an anchor rod, on which is disposed a sliding control element with a through-opening, through which the anchor rod extends, wherein the sliding control element comprises a sliding body cage having at least one recess for receiving a sliding body that is in contact with the lateral surface of the anchor rod, and having an anchor plate, which is intended to lie against a region surrounding the mouth of the bore once the sliding bolt has been introduced into the bore, wherein the anchor plate is in load-transferring connection with the sliding body cage, wherein each recess for receiving a sliding body in the sliding body cage is disposed tangentially to the lateral surface of the anchor rod, the lateral enveloping surface of each recess projects by a predefined dimension into the clear cross section of the through-opening, and each sliding body fills the cross section of the recess associated with it.

2. Sliding bolt according to claim 1, wherein the sliding body cage is part of an assembly adapter that is used to fasten the anchor plate against the region surrounding the mouth of the bore.

3. Sliding bolt according to claim 1, wherein the anchor rod projects through the anchor plate out of the bore.

4. Sliding bolt according to claim 3, wherein the portion of the anchor rod projecting from the bore is provided with one or more markings that indicate a sliding path that is still available.

5. Sliding bolt according to claim 4, wherein the markings are colored markings, wherein a region of the anchor rod next to the anchor plate is colored green, a region axially adjacent thereto is colored yellow, and a succeeding region comprising the free end of the anchor rod is colored red.

6. Sliding bolt according to claim 1, wherein a protective tube that concentrically surrounds the anchor rod extends from the anchor plate in the direction of the bore-side end of the anchor rod, wherein one end of the protective tube is fastened to the sliding body cage and the other end is fastened to the anchor plate.

7. Sliding bolt according to claim 6, wherein the protective tube is fastened to the anchor plate by means of an assembly adapter that is screwed onto the free end of the protective tube.

8. Sliding bolt according to claim 6, wherein the assembly adapter has a through-recess disposed coaxially with the anchor rod, and that on the free end of the anchor rod or in the region thereof a stop element is fastened, the diameter of which is larger than the diameter of the through-opening and which in an initial state of the sliding bolt is situated in the through-recess.

9. Sliding bolt according to claim 8, wherein in the initial state of the sliding bolt an outside end face of the stop element terminates flush with an outer edge of the assembly adapter that surrounds the end face.

10. Sliding bolt according to claim 8, wherein the anchor rod or an extension thereof projects out of the assembly adapter and is provided there preferably with one or more markings that indicate a sliding path that is still available.

11. Sliding bolt according to claim 10, wherein the markings are colored markings, wherein a portion of the anchor rod or of an extension thereof that is next to the anchor plate is colored green, a region axially adjacent thereto is colored yellow, and a succeeding portion comprising the free end of the anchor rod or of an extension thereof is colored red.

12. Sliding bolt according to claim 6, wherein a sliding-path detection element, in particular a band, wire, thread or the like, is fastened in the region of the free end of the anchor rod.

13. Sliding bolt according to claim 2, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

14. Sliding bolt according to claim 1, wherein in the sliding body cage a plurality of recesses are arranged distributed in particular uniformly around the circumference of the anchor rod.

15. Sliding bolt according to claim 14, wherein a plurality of recesses are disposed in a cross-sectional plane of the sliding body cage.

16. Sliding bolt according to claim 14, wherein the plurality of recesses are disposed in groups in different cross-sectional planes of the sliding body cage.

17. Sliding bolt according to claim 1, wherein each sliding body is conical, and taper-roller-shaped.

18. Sliding bolt according to claim 1, wherein the lateral surface of each sliding body is crowned.

19. Sliding bolt according to claim 1, wherein each sliding body is cylindrical, and roller-shaped.

20. Sliding bolt according to claim 3, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

21. Sliding bolt according to claim 4, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

22. Sliding bolt according to claim 5, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

23. Sliding bolt according to claim 7, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

24. Sliding bolt according to claim 8, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

25. Sliding bolt according to claim 9, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

26. Sliding bolt according to claim 10, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

27. Sliding bolt according to claim 11, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

28. Sliding bolt according to claim 12, wherein a mixing- and anchoring element is fastened to the bore-side end of the anchor rod and that the assembly adapter at its free end is designed to couple with an assembly device that during introduction of the sliding bolt into the bore rotates the assembly adapter and hence the sliding body cage, the anchor rod and the mixing- and anchoring element.

* * * * *